United States Patent [19]

Elcott

[11] Patent Number: 4,512,514

[45] Date of Patent: Apr. 23, 1985

[54] FLUID PULSATION APPARATUS

[76] Inventor: Teleb M. Elcott, 3809 Vista Linda Dr., Encino, Calif. 91316

[21] Appl. No.: 540,012

[22] Filed: Oct. 7, 1983

[51] Int. Cl.[3] ..... B05B 1/08

[52] U.S. Cl. ..... 239/99; 137/853; 239/101; 239/533.1

[58] Field of Search ..... 239/99, 101, 102, 533.1, 239/533.13, 533.15, 558, 569, 570, 574, 576; 4/256; 134/167 R, 167 C, 172; 137/853, 624.14

[56] References Cited

U.S. PATENT DOCUMENTS

| | | | |
|---|---|---|---|
| 3,595,255 | 7/1971 | Mulinex | 134/167 C |
| 3,792,708 | 2/1974 | Tash | 134/167 C |
| 3,802,449 | 4/1974 | Mulinex | 134/167 C |
| 3,840,033 | 10/1974 | Warsinger | 134/167 C |
| 3,883,074 | 5/1975 | Lambert | 239/102 X |
| 3,902,664 | 9/1975 | Deines | 239/102 |
| 4,077,569 | 3/1978 | Deines | 239/101 |
| 4,290,454 | 9/1981 | Shetler | 137/853 |
| 4,301,967 | 11/1981 | Hunter | 239/99 |

*Primary Examiner*—Johnny D. Cherry
*Attorney, Agent, or Firm*—Reagin & King

[57] ABSTRACT

Fluid pulsation apparatus is disclosed which includes an elastomeric sleeve designed to expand circumferentially and longitudinally in response to internal fluid pressure. A fluid barrier in the form of a disk valve is located within the sleeve, and is biased closed by an expansion spring extending between the upstream end of the sleeve and the disk valve. A rigid housing surrounds the sleeve and restricts its circumferential expansion to a predetermined level. The apparatus can be made to produce either pulsing or continuous fluid flow by adjusting the flow rate of fluid downstream of the disk valve.

8 Claims, 4 Drawing Figures

FLUID PULSATION APPARATUS

BACKGROUND OF THE INVENTION

The present invention relates to fluid pulsation devices and, more particularly, to a device which converts a steady stream of fluid into a pulsating stream without the use of rotating parts.

In recent years a number of shower heads for producing pulsating jets of water have come into widespread use. Examples of such shower heads are described in U.S. Pat. Nos. 3,801,019, 3,958,754, 4,141,502, 4,151,957, 4,190,207, 4,254,914 and 4,330,089.

Generally, these prior art shower heads produce a pulsating action by periodically interrupting the flow through each of a number of spray outlets. Many of these shower heads accomplish the pulsating action using a rotating shutter for alternately covering and uncovering a number of spray discharge openings. Others include rotating members in the form of balls driven around an annular apertured channel for producing a pulsating effect with respect to the fluid jets exiting from the head. Some of these prior art devices provide for pulsating and nonpulsating streams through separate groups of discharge outlets. One of the major disadvantages of the prior art rotary designs is the need for large numbers of rotating parts in conjunction with small diameter fluid orifices and many fluid seals. With use, the rotating parts tend to wear, the orifices often clog, and the seals eventually leak. Due to the complicated nature of these devices, they are costly to produce.

Accordingly, it is an object of the present invention to provide a new and improved fluid pulsation device.

It is another object of the present invention to provide a novel fluid pulsation device having no rotating parts.

It is yet another object of the present invention to provide non-rotating apparatus for producing pulsating and nonpulsating fluid jets to a hand held shower head.

It is yet another object of the present invention to provide apparatus which emits a pulsating fluid jet of higher pressure than the incoming fluid pressure.

SUMMARY OF THE INVENTION

The foregoing and other objects of the invention are accomplished by providing fluid pulsation apparatus having a generally tubular elastomeric sleeve with upstream and downstream ends which communicate, respectively, with the apparatus inlet and outlet. The sleeve is designed to expand circumferentially in response to internal fluid pressure generated by a continuous stream of fluid flowing under pressure into the inlet.

A tubular rigid housing surrounds the elastomeric sleeve and is designed to restrict its circumferential expansion to a predetermined expansion limit. A fluid barrier in the form of a disk valve is located within the sleeve and acts to block fluid flow through the sleeve when the disk valve is closed. An expansion spring connected between the upstream end of the sleeve and the disk valve biases the valve closed in opposition to inlet water pressure.

The spring is selected to permit the valve to open when the internal fluid pressure between the upstream end of the sleeve and the valve reaches a first level which is great enough to cause the elastomeric sleeve to expand circumferentially to the predetermined expansion limit, but which is less than the static pressure of the inlet fluid. The valve remains open until the internal fluid pressure drops to a second level less than the first level.

The flow of fluid downstream of the valve is sufficiently unrestricted to permit the internal fluid pressure to drop below the second level when the valve is opened. Accordingly, the valve is caused to sequentially open and close, generating a pulsating fluid stream at the outlet.

In one embodiment of the invention, a flow restriction valve is placed downstream of the disk valve and is used to convert the pulsating stream to a continuous stream by restricting the flow sufficiently to prevent the sleeve internal fluid pressure from dropping below the second level.

Other objects, features, and advantages of the invention will become apparent from a reading of the specification in conjunction with the drawings in which like reference numerals designate like elements in the several views.

DESCRIPTION OF THE PREFERRED EMBODIMENT

Figure 1:
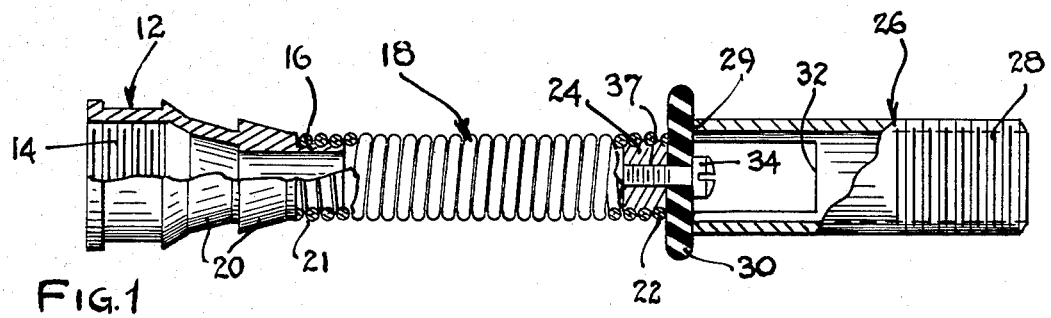
FIG. 1 is a side view of the fluid pulsation apparatus constructed in accordance with the teachings of the invention, with the elastomeric sleeve and rigid housing portions of the apparatus removed to show the internal elements of the apparatus.

Referring to FIG. 1, there is shown an assembly of the internal components used to construct a fluid pulsation device in accordance with the teachings of the invention. A hollow fluid inlet fitting 12 which may be formed of rigid material such as plated brass, stainless steel or PVC plastic, is provided with a female threaded upstream end 14 which serves as the inlet of the pulsation apparatus and is designed to connect to a conventional source of pressurized fluid such as a household water supply. A downstream portion 16 of the fitting 12 is provided with serrations on its outer surface which are designed to engage with and retain an upstream end 21 of a hollow coil expansion spring 18 typically formed of steel which is plated to resist corrosion. The portion of the fitting 12 between the ends 14 and 16 is shaped having tapered grooves 20 on its outer surface.

A downstream end 22 of the spring 18 is fitted over a short cylindrical rod 24 having a serrated outer surface designed to retain the end 22. A hollow fluid outlet fitting 26, which may be formed of the same material as the inlet fitting 12, is provided having a male threaded downstream end 28 which serves as the outlet of the pulsation apparatus. An upstream end 29 of the fitting 26 is closed off by a rigid disk 30 which is either molded as part of the outlet fitting 26 or is attached to the end 29 using adhesive, welding or other suitable fastening techniques. One or more openings 32 are provided in the wall of the fitting 26 adjacent the downstream side of the disk 30. A screw 34 fits through an opening 36 provided in the center of the disk 30 and is threaded into a suitable opening 37 provided in the center of the rod 24 to fasten the disk 30 and fitting 26 to the end 22 of the spring 18.

Figure 2:
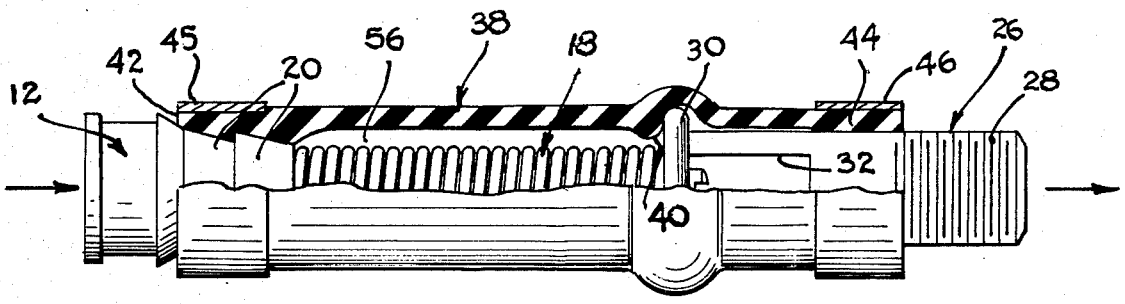
FIG. 2 is a side view of the apparatus of the present invention showing the internal elements of FIG. 1 positioned within the elastomeric sleeve which is partially cut away for clarity.

Referring to FIG. 2, an elastomeric sleeve 38 is fitted over the assembly of FIG. 1. The sleeve 38 may be molded of silicone rubber or other suitable material which is chemically inert and has relatively constant elastomeric properties over the anticipated range of inlet fluid temperatures. The sleeve 38 is designed to expand both circumferentially and longitudinally in response to internal pressure generated by the inlet fluid.

The sleeve 38 includes an annular shoulder 40 which projects into the interior of the sleeve 38. As shown in FIG. 2, when the sleeve 38 is in place and is in its relaxed or unexpanded state and the spring 18 is in its unexpanded state, the disk 30 is positioned against the downstream side of the shoulder 40. The disk 30 and the shoulder 40 combine to form a disk valve with the shoulder 40 acting as a valve seat which fits tightly around the outer circumference of the disk 30 to form a fluid barrier.

An upstream end 42 of the sleeve 38 is designed to fit tightly over the tapered grooves 20 of the fitting 12 to form a fluid-tight seal. A downstream end 44 of the sleeve 38 fits tightly around the fitting 26 downstream of the openings 32. Metal sleeves 45 and 46 are crimped or swaged in place around the ends 42 and 44, respectively, of the sleeve 38 to strengthen the seals at these ends.

Figure 3:
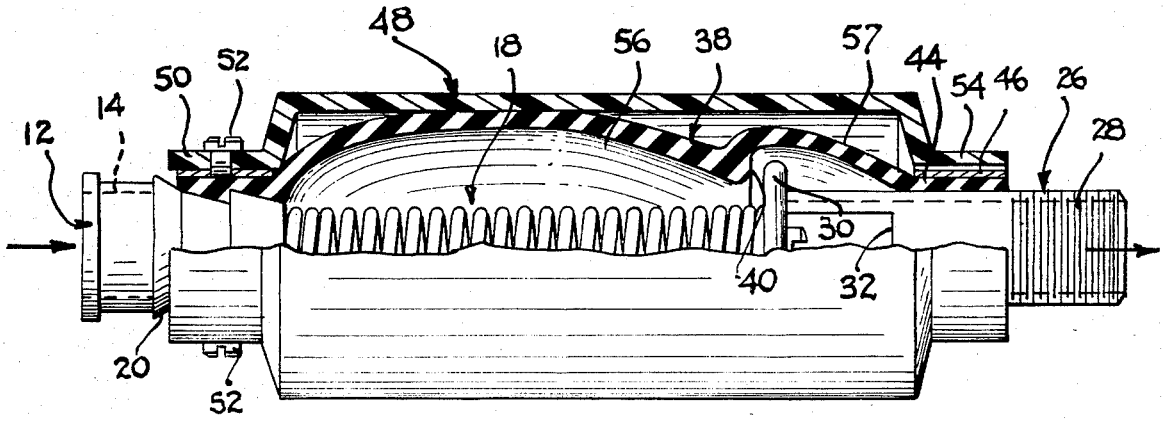
FIG. 3 is a side view of the apparatus of the present invention showing the internal elements and elastomeric sleeve of FIG. 2 positioned within the rigid housing with both the sleeve and the housing partially cut away for clarity and further showing the position of the elastomeric sleeve and the disk valve when the disk valve in the apparatus is forced open by inlet fluid pressure.

The assembly of FIG. 2 is placed into a rigid housing 48 as shown in FIG. 3. The housing 48 may be formed of PVC plastic or other suitable material. A reduced diameter upstream end 50 of the housing 48 is clamped to the sleeve 45 using screws 52 or other suitable fastening means. The inside diameter of the central portion of the housing 48 is chosen to permit the sleeve 38 to expand to a predetermined limit of expansion. A reduced diameter downstream end 54 of the housing 48 provides clearance around the metal sleeve 46, thus permitting the elastomeric sleeve 38 to expand longitudinally.

The operation of the apparatus described thus far is as follows. A pressurized source of liquid is provided to the inlet 14. The liquid flows through the fitting 12 and between the coils of the spring 18 to fill a chamber 56 formed inside the sleeve 38 between the fitting 12 and the disk 30. The spring 18 is designed to maintain the disk 30 in a closed position relative to the shoulder 40, thus blocking flow through the sleeve 38, until the sleeve 38 has circumferentially expanded against the housing 48 in response to inlet fluid pressure, as shown in FIG. 3.

After the sleeve 38 has circumferentially expanded, the spring 18 permits the disk 30 to move to an open position before the pressure in the chamber 56 reaches the static pressure of the inlet fluid. This level of pressure at which the disk valve opens is hereinafter referred to as the first level of pressure. It will be noted from FIG. 3 that movement of the disk 30 to an open, or downstream, position is accompanied by longitudinal expansion of the sleeve 38 since the disk 30 is coupled to the end 44 of the sleeve 38 by the rigid fitting 26. A portion 57 of the sleeve 38 downstream of the shoulder 40 directly affects the longitudinal and circumferential expansion characteristics of the sleeve 38. It has been found that making the portion 57 less elastic than the portion of the sleeve 38 upstream of the shoulder 40 enhances the pulsating operation of the apparatus. This decrease in elasticity can be accomplished by making the wall of the sleeve 38 thicker for the portion 57.

It has also been found that the circumferential and longitudinal expansion action of the sleeve 38 acting in cooperation with the spring 18 causes the valve formed by the disk 30 and the shoulder 40 to remain open until the pressure in the chamber 56 drops to a second level of pressure less than the first level of pressure. It will be appreciated that the rate of flow of fluid downstream of the disk 30 and through the outlet fitting 26 when the disk valve opens affects the drop in pressure within the chamber 56. Without any restriction in the rate of flow of outlet fluid, the pressure in the chamber 56 drops extremely rapidly when the disk valve opens. The fluid in the chamber 56 is expelled under conditions of high pressure which may exceed the first level of pressure due to the rapid decrease in the volume of the chamber 56 as both the sleeve 38 and the spring 18 contract toward their relaxed positions. When the pressure in the chamber 56 drops below the second level of pressure, the disk valve closes, thus blocking further fluid flow, and the above described cycle is repeated. The result is that a pulsating stream of fluid is produced at the outlet 26. The coefficient of elasticity of the sleeve 38, the strength of the spring 18, the diameter of the disk 30 and the diameter of the central portion of the housing 48 may be varied to alter the frequency of fluid pulsation. In particular, the location of the spring 18 between the upstream end 42 of the sleeve 38 and the disk 30 has been found to greatly enhance the pulsating characteristics of the apparatus.

From the above discussion, it will be appreciated that if the flow rate of the fluid downstream of the disk 30 is restricted to the point where the pressure in the chamber 56 remains above the second level of pressure, the disk valve, once it has been initially opened, will remain open, thus producing a continuous stream of fluid at the outlet 26 instead of a pulsed stream. This feature of the invention can be used to advantage in constructing an adjustable shower head as described below.

Figure 4:
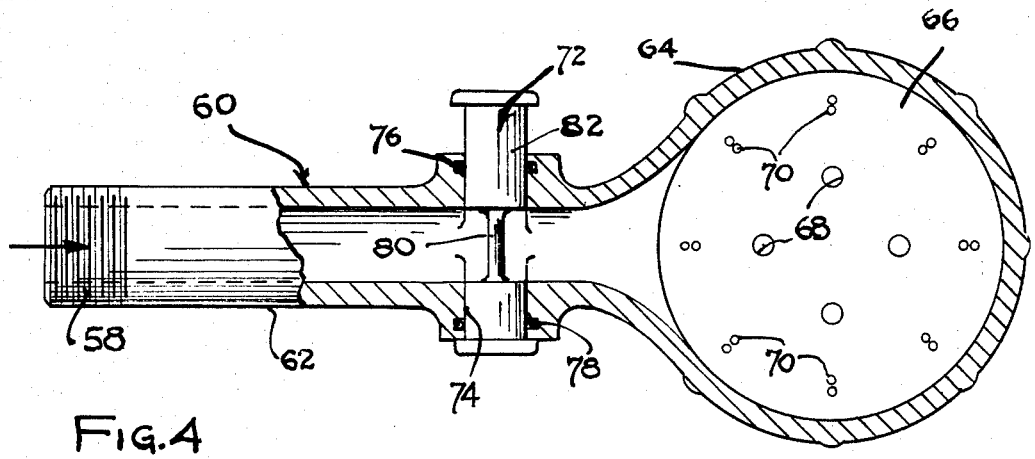
FIG. 4 is a partially cutaway side view of a shower head for use with the fluid pulsation apparatus of the present invention, showing a flow control valve used to select pulsating or continuous streams of fluid flow.

One of the applications for the fluid pulsation apparatus of the present invention described above is in conjunction with a shower head to produce a massaging shower. This can be accomplished by connecting the outlet 26 of the pulsation apparatus to an inlet 58 of a shower head 60 such as that shown in FIG. 4. This connection can be accomplished using a flexible hose of conventional construction having suitable threaded fittings.

The shower head 60 may be constructed of plastic or other suitable material and includes a hollow handle 62 communicating with the interior of a generally cylindrical head 64. The head 64 includes an outer faceplate 66 having one or more patterns of fluid orifices 68, 70 extending therethrough. As is well known to those skilled in the art, the faceplate 66 may be designed to rotate with respect to an adjacent perforated plate, thus allowing the selection of particular sets of orifices to provide different fluid jet patterns.

A slide valve is provided in the handle 62 to select between pulsating and continuous spray as follows. A valve spindle 72 is slidably mounted transverse to the flow of liquid in an opening 74 provided in the handle 62. O-rings 76 and 78 provide fluid seals. The spindle 72 includes a thin portion 80 and an enlarged portion 82. A user may reduce the flow rate through the handle 62 by pressing the spindle 72 downward in FIG. 4, where the enlarged portion 82 partially blocks the fluid passage in the handle 62. Essentially unobstructed flow can be achieved by pressing the spindle 72 upward to the position shown in FIG. 4 so that only the thin portion 80 projects into the fluid path. Since the flow rate through the handle 62 establishes the flow rate of the fluid downstream of the disk 30 in the pulsation apparatus, the spindle 72 can be used as a flow restrictor to cause the fluid flow in the head 64 to change from pulsating to continuous and vice versa.

While a preferred embodiment of the invention has been shown and described, it is to be understood that various other adaptations and modifications may be made within the spirit and scope of the invention. It is thus intended that the invention be limited in scope only by the appended claims.

What is claimed is:

1. Fluid pulsation apparatus having a fluid inlet and outlet for converting a continuous stream of fluid flowing under pressure into the inlet into a pulsating stream exiting from the outlet, comprising:

a generally tubular elastomeric sleeve having upstream and downstream ends which communicate, respectively, with the apparatus inlet and outlet and which is designed to expand circumferentially in response to internal pressure generated by the inlet fluid stream;

a generally tubular rigid housing surrounding the elastomeric sleeve and designed to restrict its circumferential expansion to a predetermined expansion limit;

fluid barrier means located within the elastomeric sleeve for blocking fluid flow through that sleeve to the outlet when the barrier means is held in an upstream closed position; and bias means positioned between the inlet and the barrier means for biasing the barrier means in its closed position in opposition to an internal fluid pressure generated within the elastomeric sleeve between its upstream end and the barrier means by the inlet fluid stream, the bias means selected to allow the barrier means to open when the internal fluid pressure reaches a first level which is sufficient to cause the elastomeric sleeve to expand circumferentially to the predetermined expansion limit, but is less than the static pressure of the inlet fluid, where the barrier means remains open until the internal fluid pressure drops to a second level less than the first level, and where the flow of fluid downstream of the barrier means is sufficiently unrestricted to permit the internal fluid pressure to drop below the second level when the barrier means is open, whereby the barrier means is caused to sequentially open and close, generating the pulsating fluid stream at the outlet of the apparatus.

2. The apparatus of claim 1 further including flow restriction means positioned downstream of the barrier means for restricting the flow of fluid through the apparatus when the barrier means is open, said restriction means being sufficient to prevent the internal fluid pressure from dropping below the second level, whereby the barrier means remains open, and a continuous stream of fluid appears at the outlet of the apparatus.

3. The apparatus of claim 2 further including a shower head having multiple fluid orifices for producing one or more fluid spray patterns, and connector means for operatively connecting the shower head to the outlet of the apparatus.

4. The apparatus of claim 3 in which the flow restriction means includes an adjustable valve mounted on the shower head to restrict the flow of water from the apparatus outlet to the shower head orifices.

5. The apparatus of claim 1 in which the elastomeric sleeve includes an annular shoulder formed between the upstream and downstream ends of the sleeve and projecting inwardly from the wall of the sleeve, in which the barrier means includes a disk designed to seat against the downstream side of the shoulder to form a disk valve, and in which the bias means includes a spring extending along the interior of the sleeve between the disk and the upstream end of the sleeve to bias the disk against the downstream side of the shoulder.

6. The apparatus of claim 5 further including a rigid outlet tube having a first end fastened against the downstream side of the disk, having at least one opening in the side of the tube adjacent the first end which communicates with the interior of the outlet tube, and having a second end which extends through the downstream end of the elastomeric sleeve, which end is sealably fastened to the wall of the outlet tube downstream of the side opening; and in which the elastomeric sleeve is designed to expand longitudinally.

7. The apparatus of claim 6 further including a rigid inlet tube which extends through the upstream end of the elastomeric sleeve and is sealably fastened thereto, in which an upstream end of the spring is attached to the inlet tube, and in which an upstream end of the rigid housing is fastened to the inlet tube.

8. The apparatus of claim 6 in which the portion of the elastomeric sleeve downstream of the annular shoulder is less elastic than the portion of the sleeve upstream of the shoulder.

* * * * *